United States Patent [19]

Alba et al.

[11] Patent Number: 4,539,819

[45] Date of Patent: Sep. 10, 1985

[54] REVERSIBLE MEAT KEEPER FOR REFRIGERATOR

[75] Inventors: Donald Alba, Marengo; Michael A. Hawkes, South Amana, both of Iowa

[73] Assignee: Amana Refrigeration, Inc., Amana, Iowa

[21] Appl. No.: 652,023

[22] Filed: Sep. 19, 1984

[51] Int. Cl.[3] ..... F24F 3/16

[52] U.S. Cl. ..... 62/78; 62/265; 62/382; 62/408

[58] Field of Search ..... 62/78, 265, 407, 408, 62/441, 382

[56] References Cited

U.S. PATENT DOCUMENTS

| | | | |
|---|---|---|---|
| 3,364,694 | 1/1968 | Cohen et al. | 62/265 |
| 3,935,714 | 2/1976 | Woolley | 62/265 |
| 4,488,412 | 12/1984 | Weaver et al. | 62/408 X |

*Primary Examiner*—Lloyd L. King

*Attorney, Agent, or Firm*—William R. Clark; Joseph D. Pannone

[57] ABSTRACT

A refrigerator having a reversible cold air meat keeper for providing convenient access thereto regardless of the side of the refrigerator that the doors are hinged. The cold air is channeled into a plenum behind the back wall of the refrigerator compartment and there are at least two spaced ports communicating from the plenum into the chamber. The cold air meat keeper has a conduit extending from the rear wall thereof. In one predetermined mounting position of the meat keeper, the conduit removably couples with one of the ports for receiving cold air from the plenum. In the alternate predetermined mounting position of the meat keeper, the conduit removably couples with the other port for receiving cold air.

14 Claims, 8 Drawing Figures

FIG. 6
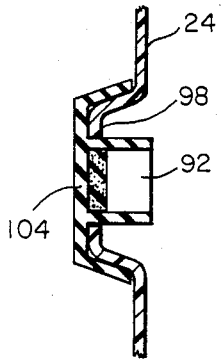
FIG. 5
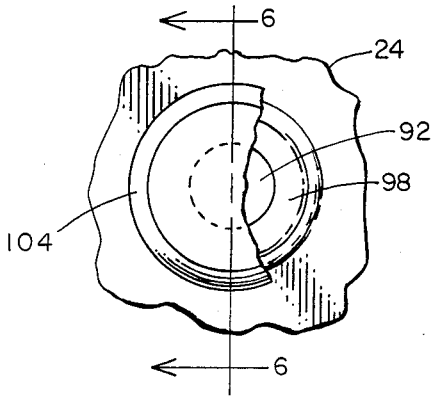
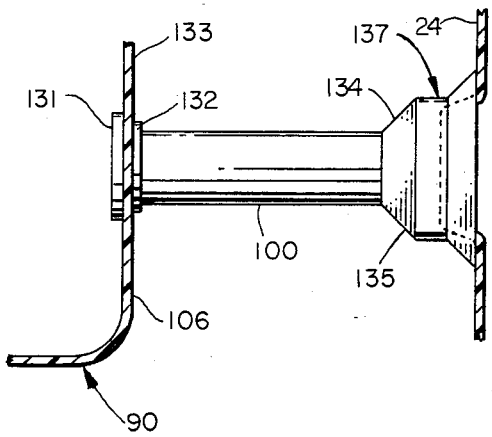
FIG. 7
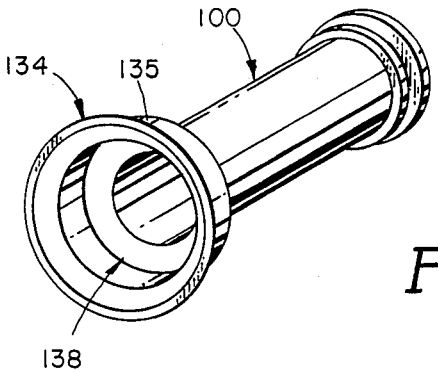
FIG. 8

REVERSIBLE MEAT KEEPER FOR REFRIGERATOR

BACKGROUND OF THE INVENTION

As is well known, meat keepers are used in refrigerators to preserve meat at an optimum temperature which is generally 5°–8° F. cooler than the rest of the refrigerated food compartment. More specifically, meat keepers preferably maintain meat at a temperature just slightly above the freezing point of water. One common embodiment for a meat keeper is defined by a meat container having an outer sleeve or sheath in which the container is slidably mounted. Chilled air at the appropriate temperature is directed into the sleeve from a conduit coupled to a cold air duct behind the rear wall of the refrigerated food compartment. As a result, the meat in the container is kept at a temperature below the general temperature of the refrigerated food compartment. Some of the chilled air in the sleeve may be directed into the meat container but it should be a small percentage and preferably adjustable because too much chilled air passing over the meat tends to dehydrate it while too little chilled air tends to make it slimy.

Commonly, refrigerators have reversible doors so that they can be installed to open from either the right or left side so as to provide flexibility for different kitchen floor plans. Generally, it is preferable that a meat keeper be mounted on the opposite side from the door hinges so as to simplify access to the meat keeper. For example, when the meat keeper is mounted on the opposite side from the door, the door doesn't have to be all the way open to pull the meat keeper out. Accordingly, if the door is reversed from one side to the other, it is also desirable to reverse the meat keeper so that it is still opposite the door hinges. One prior art approach to providing a reversible meat keeper was to provide a single port in the center of the back wall of the refrigerated food compartment and to couple a jointed arm conduit to it. The conduit could be rotated to either the left or the right depending on where the meat keeper was mounted. Such apparatus, however, was difficult to align during a reversing procedure and the jointed arm encumbered the central rear portion of the refrigerated food compartment.

SUMMARY OF THE INVENTION

The invention defines a refrigerator comprising a compartment having a back wall, a meat keeper adapted for mounting in alternate first and second positions in the compartment, a cold air plenum behind the back wall for supplying cold air to the meat keeper, a first port in the back wall for directing the cold air from the plenum to the meat keeper in the first position, and a second port in the back wall for directing the cold air from the plenum to the meat keeper in the second position, the second port being spaced from the first port in the back wall. One object of the invention is to provide a meat keeper that is easily reversible from one side to the other so as to provide convenient access regardless of the side that the refrigerator door is mounted. The plenum may take on a variety of configurations such as an air duct that has a T leading to the respective first and second ports. Also, the cold air plenum may define a single chamber from which the first and second ports communicate into the compartment. The first position for the meat keeper may be on the left side and the second position may be on the right side. It may be preferable that a plug be used to cover the port that is not being used for providing the cold air to the meat keeper. A typical meat keeper may define a meat container surrounded by an outer sleeve wherein the cold air is circulated between the two with a small percentage of the cold air being directed through the meat container. It may also be preferable that the meat container comprise a conduit fabricated of a flexible material such as rubber which extends from the rear of the meat keeper and provides self-alignment with either the first or second ports depending on whether the meat keeper is mounted in the first or second position.

The invention further defines a refrigerator comprising a refrigerator compartment having a back wall, a cold air plenum behind the back wall of the compartment, at least first and second spaced ports in the back wall communicating from the cold air plenum into the compartment, a meat keeper, means for mounting the meat keeper in the compartment in a first position wherein the meat keeper aligns with the first port for receiving cold air from the plenum through the first port, and means for mounting the meat keeper in the compartment in a second position spaced from the first position wherein the meat keeper aligns with the second port for receiving the cold air from the plenum.

The invention may also be practiced by a refrigerator comprising a refrigerated food compartment having a back wall, a source of cold air, means for directing the cold air into the compartment for refrigerating the compartment, an air duct behind the back wall for receiving cold air from the cold air source, at least first and second ports in the back wall communicating from the air duct to the compartment, a meat keeper having means for receiving a flow of cold air for maintaining the temperature in the meat keeper below the temperature in the compartment, means for supporting the meat keeper in alternate first and second positions wherein, in the first position, the receiving means couples with the first port for receiving the cold air from the air duct through the first port and wherein, in the second position, the receiving means couples with the second port for receiving the cold air from the air duct.

The invention further defines a refrigerator comprising a refrigerator compartment having a back wall, a cold air plenum behind the back wall of the compartment, first and second ports in the back wall communicating from the plenum into the compartment, a meat keeper having a conduit extending therefrom, means for supporting the meat keeper in a first position in the compartment wherein the conduit removably couples with the first port for directing the cold air from the plenum through the first port to the meat keeper, means for supporting the meat keeper in a second position in the compartment wherein the conduit removably couples with the second port for directing the cold air from the plenum through the second port to the meat keeper, and a removable plug for covering the second port when the meat keeper is in the first position and for covering the first port when the meat keeper is in the second position.

The invention may also be practiced by the method of reversing the side that a cold air meat keeper is mounted in a refrigerator compartment having a plenum behind its back wall for supplying the meat keeper, comprising the steps of removing the meat keeper from a premounted compartment position where a conduit extending rearwardly from the meat keeper couples with a first port in the back wall of the compartment to supply cold air from the plenum to the meat keeper, removing a plug from a second port in the back wall of the compartment, remounting the meat keeper in an alternate position spaced from the premounted position, the alternate position providing self-alignment of the conduit to the second port for receiving cold air through the second port to the meat keeper, and covering the first port with the plug.

BRIEF DESCRIPTION OF THE DRAWINGS

The foregoing objects and advantages will be more fully understood by reading the description of the preferred embodiment with reference to the drawings wherein:

FIG. 5 is a partially broken-away view of a plug covering a meat keeper port;

FIG. 6 is a view taken along line 6—6 of FIG. 5;

FIG. 7 is a side view of a conduit communicating between the meat keeper sleeve and the meat keeper port; and FIG. 8 is a perspective view of the conduit.

DESCRIPTION OF THE PREFERRED EMBODIMENT

Figure 1:
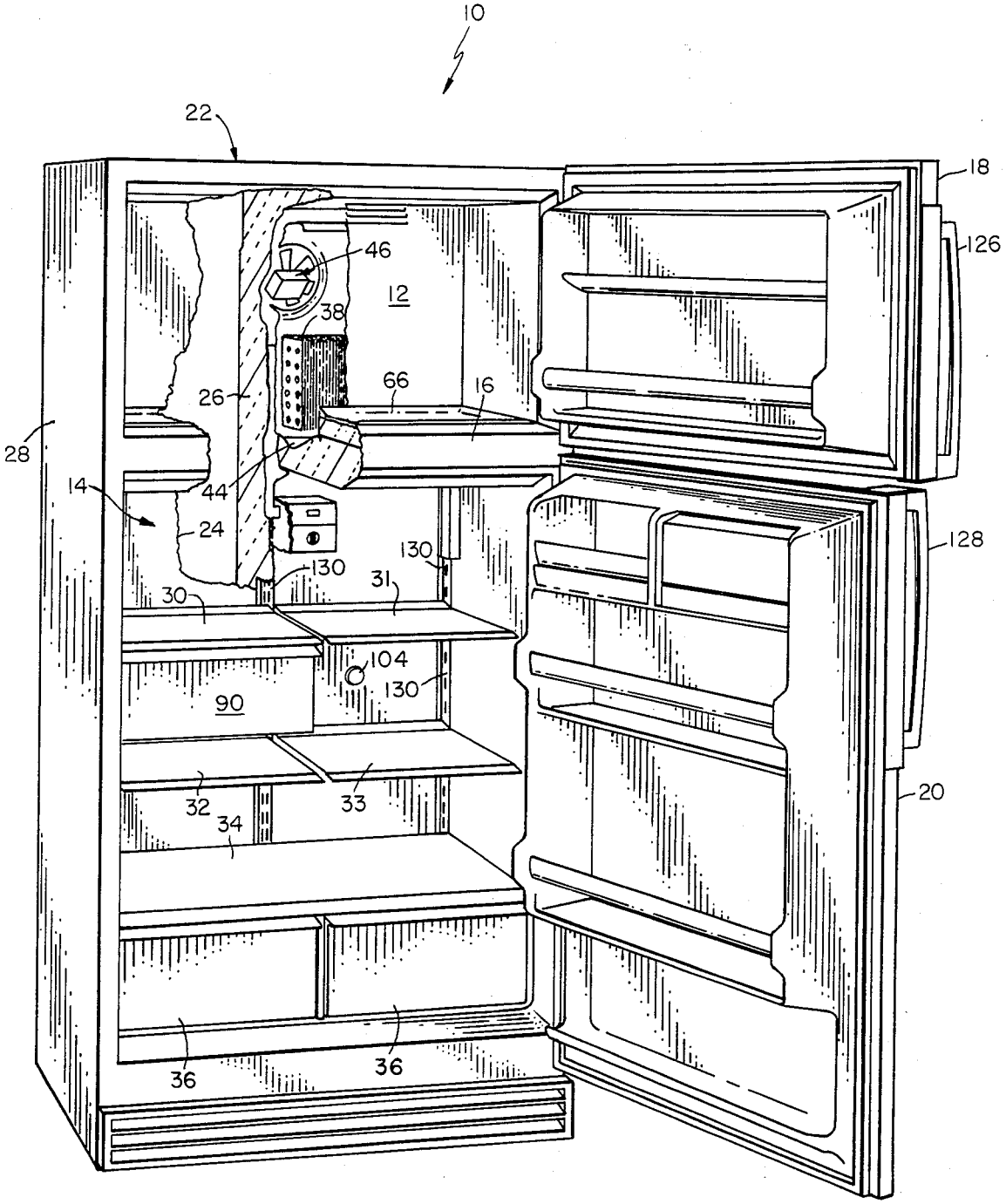
FIG. 1 is a partially broken away perspective view of a "top mount" refrigerator.
Figure 2:
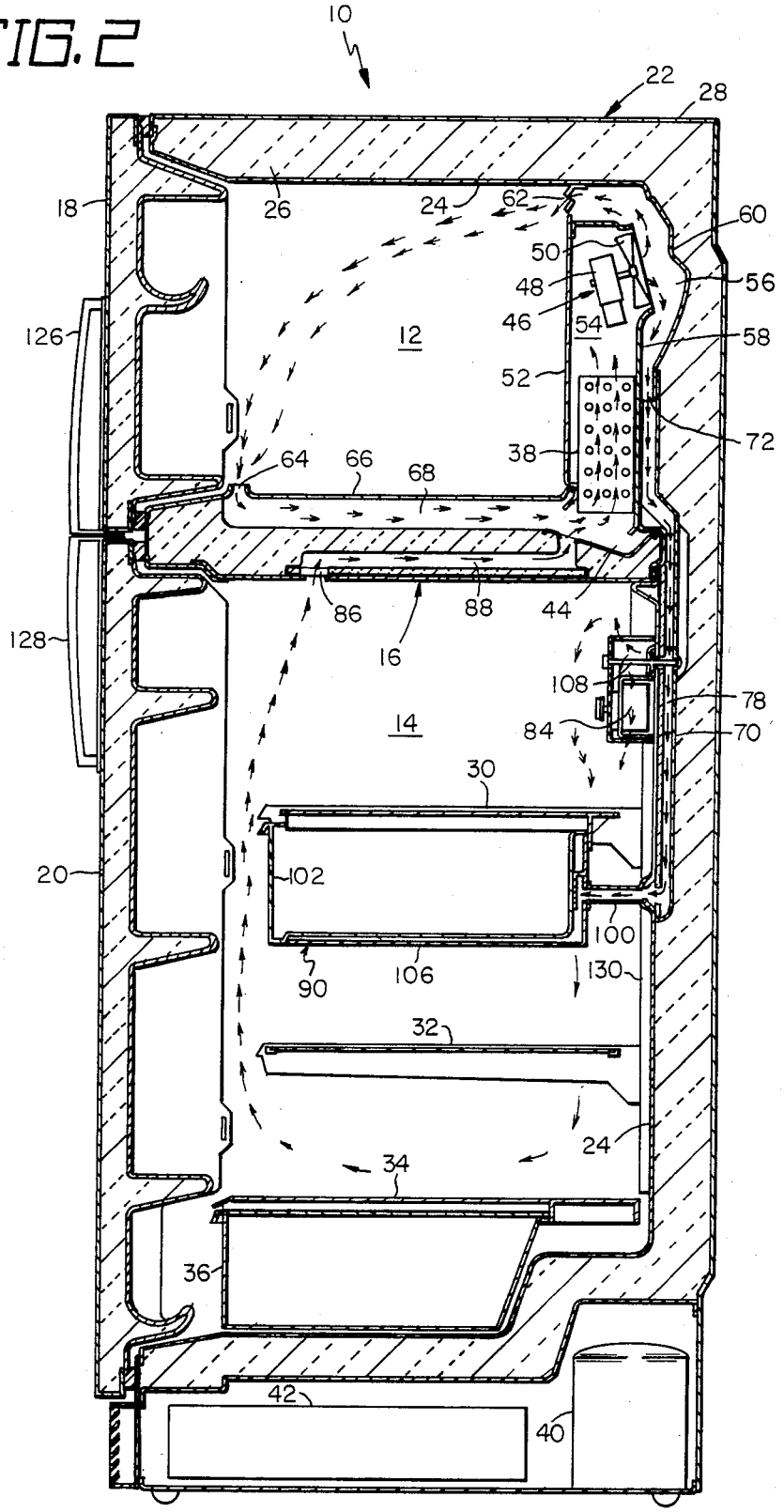
FIG. 2 is a side sectioned view of the refrigerator including side views of the controls and the meat keeper.
Figure 3:
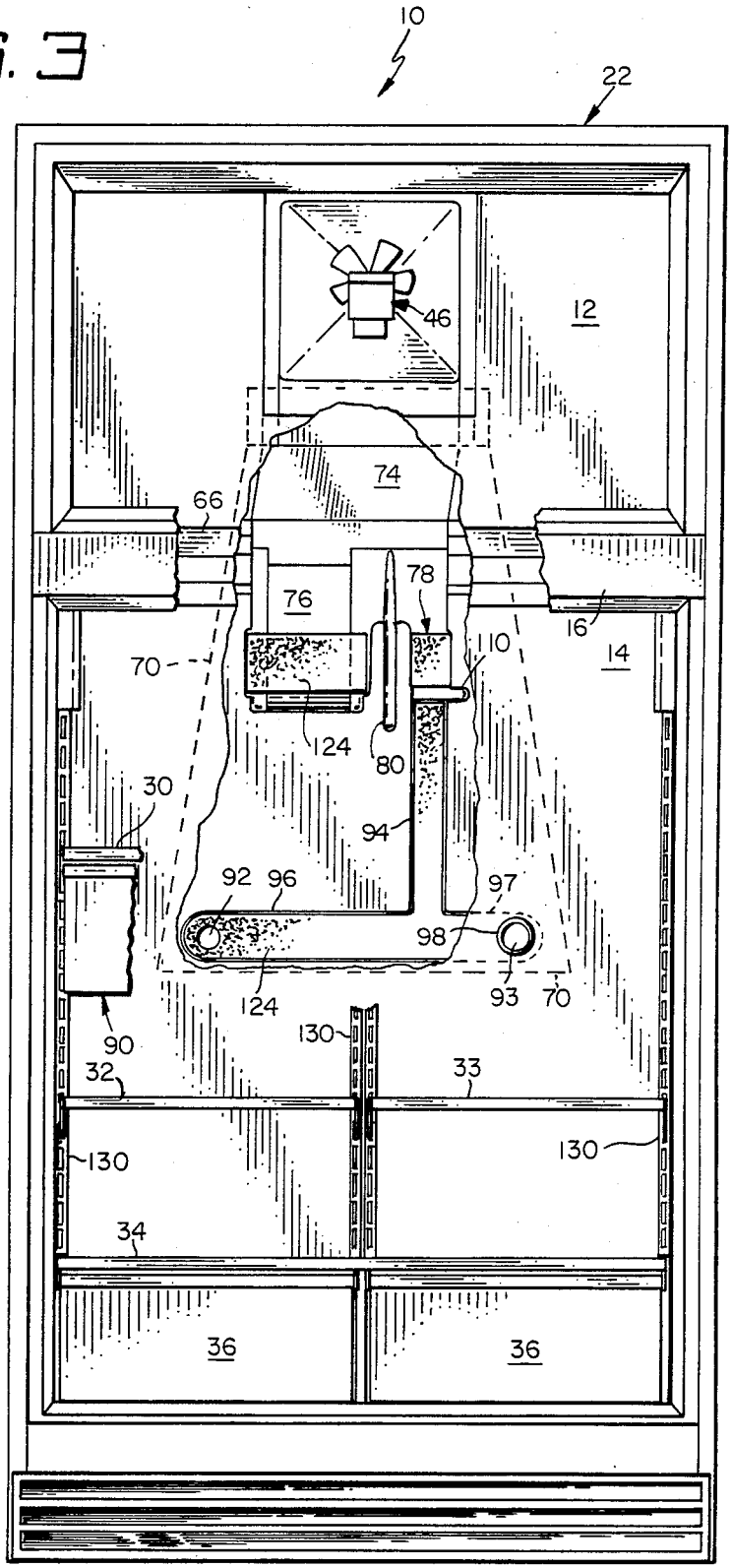
FIG. 3 is a partially broken away front view of the refrigerator with the doors removed.

Referring to FIGS. 1–3, various views of refrigerator 10 are shown. Refrigerator 10 here shown as a "top mount" refrigerator is divided into a top freezer compartment 12 and bottom refrigerated food compartment 14 by a horizontal partition 16. Door 18 closes freezer compartment 12 and door 20 closes refrigerated food compartment 14. Here, both doors 18 and 20 are shown hinged on the right side of the refrigerator cabinet 22. The cabinet 22 of refrigerator 10 generally defines a plastic liner 24 surrounded by insulation 26 which is encased by an outer shell 28 or case. As is conventional, shelves 30–34 and crisper pans 36 are mounted in the refrigerated food compartment 14.

As is well known and as shown in FIG. 2, the components of a refrigeration loop consist of an evaporator 38, compressor 40, condenser 42 and expansion valve or capillary tube (not shown). Although the interconnecting tubes of the refrigeration loop are not shown, a working fluid or refrigerant is cycled through these components such that heat is extracted from air passing across evaporator 38 to support the evaporation therein. As is shown in FIG. 2, water condensed on evaporator 38 falls into trough 44 where it is collected and carried away by a tube (not shown). Air is drawn across evaporator 38 by fan 46 which consists of a fan motor 48 and fan blades 50. Fan 46 is located behind the rear wall 52 of freezer compartment 12 in evaporator chamber 54. Fan 46 directs the chilled air from the evaporator chamber 54 into chamber 56 which is defined by panel 58 and liner 24. Chilled air from fan 46 impinges on dimple 60 formed in liner 24 so as to reduce static air pressure build-up by keeping the air moving radially therefrom. Chilled air directed upward in chamber 56 passes through outlet 62 in the rear wall 52 of the freezer compartment 12. Fan 46 draws air back from freezer compartment 12 through inlet 64 in the floor 66 of the freezer compartment 12 and passageway 68 in horizontal partition 16. The controls for cycling compressor 40 and fan 46 on and off are conventional and are generally determined as a function of the operator setting and the temperature of freezer compartment 12.

In general, liner 24 and shroud 70 may be vacuum formed using a plastic material such as ABS. The shape of shroud 70 is generally defined by the dotted line so identified in FIG. 3. Shroud 70 is connected to the back of liner 24 and taped in place to provide an air seal between the two. With the liner 24 inserted in outer shell 28 or case, foam such as polystyrene is injected into the spacing therebetween to form the layer of insulation 26. An aperture 72 in liner 24 provides communication between chamber 56 and air duct 74 between the back of liner 24 and shroud 70. More specifically, as is well known, shroud 70 is contoured so as to provide a pattern of air passageways from chamber 56 behind the liner 24 down to the refrigerated food compartment 14.

Behind the liner 24 wall in the refrigerated food compartment 14, air duct 74 formed by shroud 70 divides into air duct branches 76 and 78 as shown in FIG. 3. Hollow 80 which appears to be a third branch is actually used to house a sensor which forms no part of the present invention. Branch 76 communicates through aperture 82 to conventional damper or baffle control 84 which is shown in detail in FIG. 4. As is well known, damper control 84 opens and closes the passageway from aperture 82 into refrigerated food compartment 14 as a function of the operator setting and the sensed temperature. More specifically, when chilled air is called for, damper control 84 opens and when the refrigeration cycle starts as determined by the freezer control, chilled air directed downward from dimple 60 by fan 46 passes through chamber 56, air duct 74, branch 76, aperture 82 and baffle control 84 into refrigerated food compartment 14. The air from the refrigerated food compartment 14 recirculates back to evaporator chamber 54 via inlet 86 and passageway 88 as shown by the arrows in FIG. 2. The apparatus and operative principles described heretofore, are conventional.

In accordance with the invention, air duct branch 78 which is used to channel chilled air to meat keeper 90 has a plurality of ports 92 and 93 into refrigerated food compartment 14. More specifically, as shown in FIG. 3, air duct branch 78 or plenum defines a trunk 94 which divides into two horizontally extending air duct legs 96 and 97. Ports 92 and 93 which are formed in liner 24 are each surrounded by a mound 98 or ridge which protrudes slightly into refrigerated food compartment as shown best in FIG. 6. As shown in FIGS. 1–3, meat keeper 90 is positioned on the left side of the refrigerated food compartment 14 because door 20 is hinged on the right side of cabinet 22. In such configuration, throat or conduit 100 communicates between port 92 and meat keeper 90 so that chilled air is circulated around meat container 102 as will be described in more detail later herein. In such case, suitable cover 104 or plug is placed on port 93 to block the flow of chilled air from passing down the right air duct leg 97 into the refrigerated food compartment 14.

Any suitable meat keeper 90 which operates with a flow of chilled air could be used. For a detailed description of an illustrative example, see U.S. Pat. No. 3,473,345, issued Oct. 21, 1969, which is hereby incorporated by reference. Briefly, the chilled air may pass between a sleeve 106 and the meat container 102 thereby maintaining the interior temperature of the meat keeper 90 approximately 5°-8° F. cooler than the rest of the refrigerator compartment which may, for example, typically be in the range from 38°-40° F. As is well known, fresh meat keeps best at a temperature just slightly above the freezing point of water. If too much air circulates over the meat, it may cause dehydration. On the other hand, if too little air circulates over meat, it may become slimy. Accordingly, it may be preferable that a small percentage of the chilled air in the sleeve 106 pass through the meat container 102.

Figure 4:
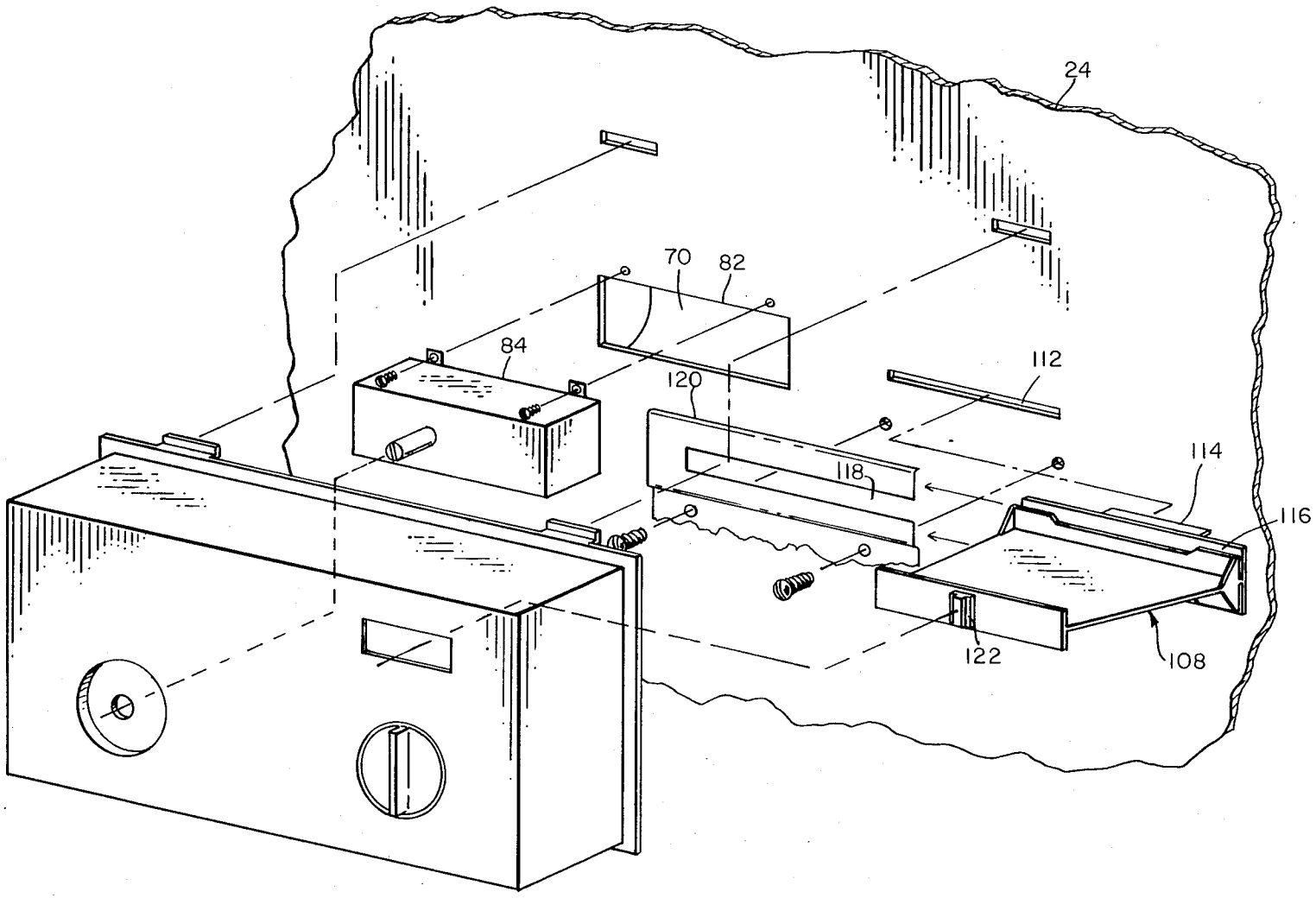
FIG. 4 is an exploded perspective view of the controls for the refrigerated food compartment and the meat keeper.

Referring again to FIG. 4, the temperature of meat keeper 90 is regulated by sliding gate valve 108. More specifically, shroud 70 is formed so that air duct branch 78 has a horizontal notch 110 aligned with slot 112 in liner 24. Sliding gate valve 108 has a slide gate 114 which inserts through slot 112 in liner 24. On the refrigerated food compartment 14 side of liner 24, slide gate valve 108 is supported by having a groove 116 which seats in and engages guide slot 118 of bracket 120. Using handle 122, the operator can push slide gate valve 108 laterally in guide slot 118. In the left-most position as shown in FIG. 4, slide gate 114 blocks branch 78 preventing the flow of chilled air to meat keeper 90. In the right-most position, slide gate 114 is totally within notch 110 so that it has no affect on the flow of chilled air to meat keeper 90. At varying positions in between, slide gate 114 shuts off the flow of chilled air to meat keeper 90 in varying amounts. Bars 124 of foam insulation are positioned in air duct branches 76 and 78 between liner 24 and the chilled air paths as shown.

Doors 18 and 20 can be reversed to suit user preference or kitchen layout. In such case, doors 18 and 20 are removed from cabinet 22. From the view as shown in FIG. 1 with handle 126 and 128 on the left side of the respective doors, handles 126 and 128 are removed and handle 126 is installed on the right side of door 20 and handle 128 is installed on the right side of door 18. Then, after remounting the hinges on the left side of refrigerator cabinet 22, doors 18 and 20 are hung accordingly. To provide access to meat keeper 90 without having door 20 completely open, it may then be desirable to reverse meat keeper 90 from the left side as shown in FIG. 1 to the right side. In accordance with the advantages of the invention, shelf 31 is first removed. To make the reversing procedure easier, meat container 102 is next removed from the sleeve 106 of meat keeper 90. Referring to FIG. 5 there is shown a partially broken-away front view of port 93 sealed by cap or plug 104. FIG. 6 is a view taken along line 6—6 of FIG. 5. Plug 104 is removed from port 93 by pulling it forward. Shelf 30 like the other shelves is supported in cantilever fashion by shelf support tracks 130 running vertically along the back of liner 24. Shelf 30 also has sleeve 106 connected integrally thereto and suspended underneath. Shelf 30 including sleeve 106 is then removed and repositioned on the right side of refrigerator food compartment 14. In the proper vertical height, rubber throat or conduit 100 automatically aligns with port 93. More specifically, referring to FIG. 7, there is shown a side view of conduit 100 connected to sleeve 106 and aligned with a port 92 or 93. FIG. 8 is a perspective view of conduit 100. The back wall 133 of sleeve 106 is snugly engaged between spaced flanges 131 and 132 of conduit 100 thereby securely connecting conduit 100 to sleeve 106 in a horizontally extending position. The shelf support tracks 130 are located so that when shelf 30 is located in a predetermined vertical connection, conduit 100 is horizontally and vertically aligned with a port 92 or 93. The opposite end 134 of conduit 100 has a stepped collar 135 which readily mates with mound 98 of the respective port thereby providing a junction 137 that has sufficient sealing to direct substantially all of the chilled air from the respective air duct leg 96 or 97 into sleeve 106 via conduit 100. Junction 137 is also engageable and disengageable by merely mounting or dismounting shelf 30; the alignment of stepped collar 135 to mound 98 is provided in response to the mounting and there are no other required steps. Needless to say, the procedure for moving the meat keeper 90 to the right side of compartment 14 is then completed by covering port 92 with plug 104 and mounting shelf 31 where shelf 30 was previously mounted on the left side. Also, it is apparent that the procedure for moving the meat keeper from the right side to the left side of compartment 14 would be similar.

The alternate air duct legs 96 and 97 are behind liner 24 and accordingly the interior of refrigerated food compartment 14 is not encumbered with an alterable duct extending from the center of the back wall of liner 24. Another advantage of the reversible meat keeper embodiment described herein is that the procedure for reversing the side of the meat keeper is fast and easy such that it can readily be accomplished by one other than a trained technician. For example, the tapering of mouth 138 of stepped collar 135 provides self-alignment to a mound 98 of a port 92 or 93. Further, although the preferred embodiment as shown in FIGS. 1 and 3 has only two ports 92 and 93 to channel chilled air to alternate meat keeper positions on the left and right side of the refrigerated food compartment 14, another advantage is that a larger plurality of ports could be used such that the height of the meat keeper 90 could also be adjusted. It is also noted that because there are a plurality of individual ports 92 and 93, more than one meat keeper could be mounted in the refrigerated food compartment 14 and operated simultaneously.

This completes the description of the preferred embodiment. However, the reading of it by one skilled in the art will bring to mind many modifications and alterations without departing from the spirit and scope of the invention. Accordingly, it is intended that the scope of the invention not be limited by the preferred embodiment but only by the appended claims.

What is claimed is:

1. The method of reversing the side that a cold air meat keeper is mounted in a refigerator compartment having a plenum behind its back wall for supplying said meat keeper, comprising the steps of:

removing said meat keeper from a premounted compartment position where a conduit extending rearwardly from said meat keeper couples with a first port in said back wall of said compartment to supply cold air from said plenum to said meat keeper;

removing a plug from a second port in the back wall of said compartment;

remounting said meat keeper in an alternate position spaced from said premounted position, said alternate position providing self alignment of said conduit to said second port for receiving cold air through said second port to said meat keeper; and covering said first port with said plug.

2. A refrigerator comprising:

a refrigerator compartment having a back wall;

a meat keeper adapted for mounting in alternate first and second positions in said refrigerator compartment;

a cold air plenum behind said back wall for supplying cold air to said meat keeper;

a first port in said back wall for directing said cold air from said plenum to said meat keeper in said first position; and a second port in said back wall for directing said cold air from said plenum to said meat keeper in said second position, said second port being spaced from said first port in said back wall.

3. The refrigerator recited in claim 2 wherein said first and second positions of said meat keeper are spaced horizontally wherein said meat keeper can be mounted on either the left or right side of said refrigerator compartment to provide convenient access to said meat keeper regardless of the side that the refrigerator door is hinged.

4. The refrigerator recited in claim 2 further comprising a plug for covering said first port when said meat keeper is in said second position and for covering said second port when said meat keeper is in said first position.

5. The refrigerator recited in claim 2 wherein said meat keeper defines a meat container surrounded by an outer sleeve through which said cold air is circulated.

6. The refrigerator recited in claim 2 further comprising a conduit extending from said meat keeper for aligning with and coupling to said first or second ports.

7. A refrigerator comprising:

a refrigerator compartment having a back wall;

a cold air plenum behind said back wall of said compartment;

at least first and second spaced ports in said back wall communicating from said cold air plenum into said compartment;

a meat keeper;

means for mounting said meat keeper in said compartment in a first position wherein said meat keeper aligns with said first port for receiving cold air from said plenum through said first port; and means for mounting said meat keeper in said compartment in a second position spaced from said first position wherein said meat keeper aligns with said second port for receiving said cold air from said plenum.

8. The refrigerator recited in claim 7 further comprising a plug for covering said second port when said meat keeper is in said first position and for covering said first port when said meat keeper is in said second position.

9. The refrigerator recited in Claim 7 further comprising a conduit extending from said meat keeper for mating with said first port when said meat keeper is in said first position and for mating with said second port when said meat keeper is in said second position.

10. A refrigerator comprising:

a refrigerated food compartment having a back wall;

a source of cold air;

means for directing said cold air into said compartment for refrigerating said compartment;

an air duct behind said back wall for receiving cold air from said cold air source;

at least first and second ports in said back wall communicating from said air duct to said compartment;

a meat keeper having means for receiving a flow of cold air for maintaining the temperature in said meat keeper below the temperature in said compartment;

means for supporting said meat keeper in alternate first and second positions wherein, in said first position, said receiving means couples with said first port for receiving said cold air from said air duct through said first port and wherein, in said second position, said receiving means couples with said second port for receiving said cold air from said air duct.

11. The refrigerator recited in claim 10 further comprising a plug for covering said second port when said meat keeper is in said first position and for covering said first port when said meat keeper is in said second position.

12. The refigerator recited in claim 10 wherein said receiving means comprises a flexible rubber conduit extending from said meat keeper, said conduit having one end with a mouth adapted for mating with said first or second ports.

13. A refrigerator comprising:

a refrigerator compartment having a back wall;

a cold air plenum behind said back wall of said compartment;

first and second ports in said back wall communicating from said plenum into said compartment;

a meat keeper having a conduit extending therefrom;

means for supporting said meat keeper in a first position in said compartment wherein said conduit removably couples with said first port for directing said cold air from said plenum through said first port to said meat keeper;

means for supporting said meat keeper in a second position in said compartment wherein said conduit removably couples with said second port for directing said cold air from said plenum through said second port to said meat keeper; and a removable plug for covering said second port when said meat keeper is in said first position and for covering said first port when said meat keeper is in said second position.

14. The refrigerator recited in claim 13 wherein said conduit has a flexible mouth for seating up against said back wall and sealing around said first or second port.

* * * * *